US009863204B2

(12) United States Patent
Chan et al.

(10) Patent No.: US 9,863,204 B2
(45) Date of Patent: Jan. 9, 2018

(54) DOWNHOLE CONNECTOR

(71) Applicant: Sabritec, Irvine, CA (US)

(72) Inventors: James Chungyu Chan, Irvine, CA (US); Richard Johannes, Trabuco Canyon, CA (US); Christopher Wade Nesselroad, Dana Point, CA (US)

(73) Assignee: SABRITEC, Costa Mesa, CA (US)

( * ) Notice: Subject to any disclaimer, the term of this patent is extended or adjusted under 35 U.S.C. 154(b) by 504 days.

(21) Appl. No.: 14/659,362

(22) Filed: Mar. 16, 2015

(65) Prior Publication Data

US 2015/0285008 A1 Oct. 8, 2015

Related U.S. Application Data

(60) Provisional application No. 61/974,357, filed on Apr. 2, 2014.

(51) Int. Cl.

| | |
|---|---|
| ***H01R 4/60*** | (2006.01) |
| ***E21B 33/038*** | (2006.01) |
| ***H01R 13/508*** | (2006.01) |
| ***H01R 13/533*** | (2006.01) |

(52) U.S. Cl.
CPC ..... *E21B 33/0385* (2013.01); *H01R 13/508* (2013.01); *H01R 13/533* (2013.01)

(58) Field of Classification Search
CPC ..... H01R 13/622; H01R 25/00
USPC ..... 439/502, 207, 210, 903; 166/242.6
See application file for complete search history.

(56) References Cited

U.S. PATENT DOCUMENTS 1,456,194 A * 5/1923 Rosenberg ..... F21S 6/003 248/159
1,766,929 A * 6/1930 Naul ..... A47L 9/2842 15/410
1,930,926 A * 10/1933 Doane ..... F21S 6/001 174/69
2,162,864 A * 6/1939 Rugg ..... H02G 3/00 174/68.3
3,005,037 A * 10/1961 Miller ..... H01R 13/746 174/153 R
3,400,359 A * 9/1968 Bedini ..... F21S 6/001 439/123
3,585,564 A * 6/1971 Skjervoll ..... H01R 39/00 285/279
3,671,921 A * 6/1972 Charles, III ..... H01R 13/502 439/353

(Continued)

*Primary Examiner* — Neil Abrams
(74) *Attorney, Agent, or Firm* — Snell & Wilmer L.L.P.

(57) ABSTRACT

A connector assembly for insertion into a hollow portion of a tool, fixture, or housing. The connector assembly may have a connector having two terminated end portions for reducing assembly time and cost with on-site termination. The connector assembly may include a first outer body having a hollow portion for insertion of at least a portion of a first insert-assembly sleeve portion. The connector assembly may have at least one retaining portion extruding radially inward and configured to be positioned into at least one radially inward groove of the first insert-assembly sleeve portion for securing at least a portion of the first terminated end portion in the first outer body. With this assembly, one of the terminated end portions without an outer body may be passed through the hollow portion and then assembled to the corresponding outer body and reinserted into an end of the hollow portion.

22 Claims, 21 Drawing Sheets

(56) References Cited

U.S. PATENT DOCUMENTS 4,042,291 A * 8/1977 Moriyama ..... F21S 2/00 285/907
4,072,857 A * 2/1978 DeVicaris ..... A41G 1/005 362/123
4,985,002 A * 1/1991 Maisch ..... H01R 13/65802 439/607.01
5,044,971 A * 9/1991 Hollingsworth ..... H01R 31/02 439/215
5,067,906 A * 11/1991 Woodgate ..... F21V 21/12 439/115
5,266,044 A * 11/1993 Whitney ..... H01R 31/00 439/115
5,478,243 A * 12/1995 Hopkins ..... B60D 1/62 439/35
5,489,813 A * 2/1996 Jung ..... F21S 2/00 313/25
5,776,559 A * 7/1998 Woolford ..... A47G 33/06 362/123
6,155,869 A * 12/2000 Monsef ..... G01C 15/02 439/500
6,250,955 B1 * 6/2001 Archuleta ..... H01R 9/03 439/502
6,257,923 B1 * 7/2001 Stone ..... H01R 13/516 280/422
6,341,875 B1 * 1/2002 Chu ..... F21V 19/006 362/249.06
7,040,932 B1 * 5/2006 Klitzner ..... H01R 13/60 439/668
7,183,502 B1 * 2/2007 Johnston ..... H02G 3/0431 174/480
7,185,850 B2 * 3/2007 Callahan ..... B60N 2/0725 174/74 R
7,361,039 B2 * 4/2008 Koehler ..... H01R 13/629 362/431
7,814,969 B2 * 10/2010 Shaw ..... E21B 17/028 166/242.6
9,439,528 B2 * 9/2016 Chen ..... A47G 33/06
2015/0285008 A1 * 10/2015 Chan ..... E21B 33/0385 166/242.6

* cited by examiner

DOWNHOLE CONNECTOR

CROSS-REFERENCE TO RELATED APPLICATIONS

The present application claims the benefit and priority of U.S. Provisional Application No. 61/974,357, filed Apr. 2, 2014, entitled "Downhole Connector," the entire disclosure of which is incorporated herein by reference.

BACKGROUND

1. Field

The present invention relates generally to coupling systems and improvements thereto and more particularly, to downhole connectors for insertion into housings, tools, and/or fixtures.

2. Description of the Related Art

Coupling systems for providing an interface between various devices or components of a system are widely used in a variety of applications. For example, typical electrical coupling systems utilize a mated pair of connectors that include a series of complementary pins, sockets, or other conductive contacts to provide electrical connections between electronic devices. In addition to electrical connectors, other types of connectors such as optical, hydraulic, pneumatic, or vacuum connectors or fittings may be used in a coupling system to interconnect components of other types of systems.

In certain applications, coupling systems include a connecter that is inserted in a hollow portion of a housing, tool, fixture, or the like. However, the hollow portion into the housing, tool, fixture, or the like may be too small for accepting a connector with two pre-terminated ends. A common solution known in the art has been to load a connector that has a first terminated end in the hollow portion, and terminate the second end after insertion of the connector in the hollow portion.

For example, FIGS. 1A and 1B illustrate a connector 102 that requires termination at one end after insertion into a tool 106, according to certain embodiments known in the art. A connector 102 with a first terminated end portion 104(*a*) may be inserted in a first hollow end 108 (*a*) of a hollow portion 108 of the tool 106. A radial width of the hollow portion 108 may not be great enough for allowing the first end portion 104(*a*) or the second end portion 104(*b*) to pass through the hollow portion 108. The connector 102 may have an inner width along a radial axis 101 (for example, an inner diameter of 12.7 millimeters or 0.5 inches) and an outer width along the radial axis 105 (for example, an outer diameter of 19.05 millimeters or 0.75 inches) that is greater than a radial width (e.g., a diameter) of at least a part of the hollow portion 408. Technicians have to first load the connector 102 with the first terminated end portion 104(*a*), and then manually terminate the connector 102 with the second end portion 104(*b*) after the connector 102 with the first terminated end 104(*a*) is inserted into the hollow portion 108. For example, the manual termination may include soldering the connector 102 to the second end portion 104(*b*).

There is a need in the art to reduce the complexity and labor time associated with the installation process of terminating one end of a connector after insertion into a hollow portion. Furthermore, there is a need in the art for a connector assembly pre-terminated at both ends that can be inserted in a hollow portion of a tool, housing, fixture, and/or similar units in order to streamline the installation process and reduce labor costs.

SUMMARY

In an embodiment, a connector assembly may be provided for insertion into a hollow portion of a tool, fixture, or housing. The connector assembly may have a connector having two terminated end portions for reducing assembly time and cost associated with on-site termination of the connector ends. The connector assembly may include a first outer body having a hollow portion for insertion of at least a portion of the first sleeve portion. The connector assembly may have at least one retaining portion extruding radially inward and configured to be positioned into at least one radially inward groove of the first sleeve portion for securing at least a portion of the first terminated end portion in the first outer body. Alternatively, the first outer body may have at least two removable parts configured to connect with an outer-body sleeve portion defining a hollow portion for insertion of at least a portion of the first terminated end portion.

In one embodiment, a connector assembly may be provided for insertion into a hollow portion of a tool, fixture, or housing. The connector assembly may include a connector having a first terminated end portion and a second terminated end portion; a first sleeve portion having an outer surface and an inner surface defining a hollow portion for insertion of least a portion of the first terminated end portion, and the outer surface having at least one radially inward groove; a first outer body having a hollow portion for insertion of at least a portion of the first sleeve portion; and at least one first-end retaining portion extruding radially inward and configured to be positioned into the at least one radially inward groove for securing at least a portion of the first terminated end portion in the first outer body.

In another embodiment, a connector assembly may include a connector having a first terminated end portion and a second terminated end portion; a first outer body having a first removable part and a second removable part configured to be positioned opposite of the first removable part and to be connected with the first removable part using a first plurality of interconnecting members, each of the first removable part and the second removable part having an outer surface and an inner surface, the inner surface of first removable part connected with the inner surface of the second removable part forming a hollow portion for insertion of at least a portion of the first terminated end portion; and a first outer-body sleeve portion having an inner surface defining a hollow portion for insertion of at least a portion of the first terminated end portion, the first outer-body sleeve portion being configured to connect with the first removable part of the first outer body and the second removable part of the first outer body using a second plurality of interconnecting members, wherein the first outer-body sleeve portion, the first removable part and the second removable part are configured to be inserted into the hollow portion of the tool, the fixture, or the housing.

BRIEF DESCRIPTION OF THE DRAWINGS

Other systems, methods, features, and advantages of the present invention will be or will become apparent to one with skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

Devices and systems that implement the embodiment of the various features of the present disclosure will now be described with reference to the drawings. The drawings and the associated descriptions are provided to illustrate some embodiments of the present disclosure and not to limit the scope of the present disclosure. The embodiments illustrated share various similar features, each of which may be described herein with reference to the various illustrated embodiments and with alternation between illustrations of the various embodiments.

Each drawing of FIGS. 2A-2G illustrates a pre-terminated connector 202 fitted into a first outer body 220(*a*) using a first-end retaining portion 234(*a*) positioned in at least one radially inward groove 228(*a*) to form a connector assembly 200 that is capable of being fitted into a hollow portion 208 of a tool, fixture, housing, or the like, according to certain embodiments of the present invention.

As used in this application, "(a)" followed by numerals of drawings herein indicate an element that is closer to a first longitudinal end of a connector assembly than a second longitudinal end of the connector assembly, and "(b)" followed by numerals indicate an element that is closer the second end of the connector assembly. When references to numerals followed by "(a)" are made, but numerals followed by "(b)" are omitted, it is understood that a similar element may be utilized in similar distance to the second longitudinal end of the connector assembly.

Figure 2A:
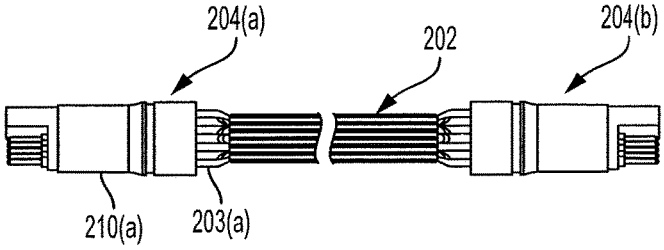
FIGS. 2A-2L each illustrate a pre-terminated connector fitted into an outer body using a retaining portion positioned in a groove to form a connector assembly that is capable of being fitted into a hollow portion of a tool, fixture, housing, or the like, according to certain embodiments of the present invention.
Figure 2B:
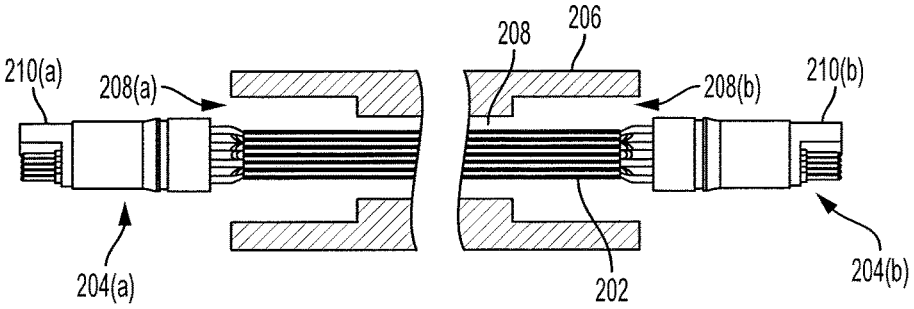

Referring to FIG. 2A, the connector 202 has a radially width that is small enough to slide through the hollow portion 208 with ease. Exemplary dimensions of the connector 202 are discussed below with respect to FIGS. 2K and 2L. Referring to FIG. 2B, the connector 202 is shown after insertion into the hollow portion 208 of a fixture, housing, or tool 206.

Figure 2C:
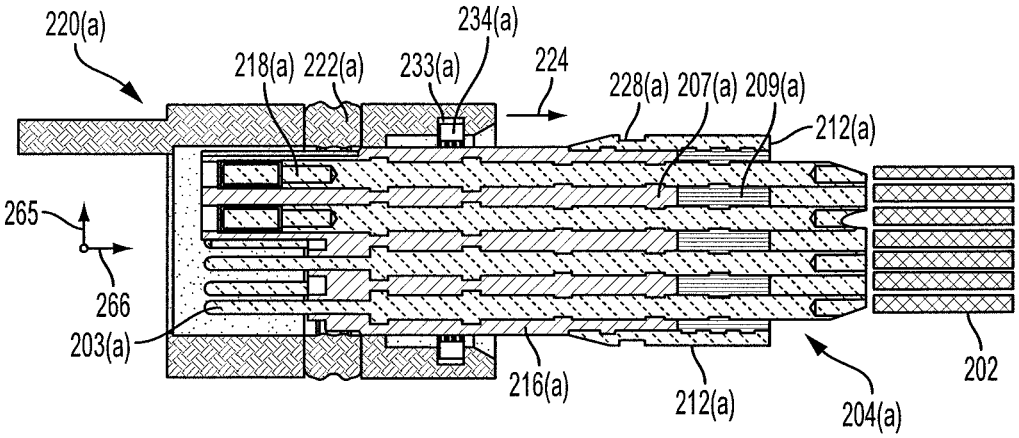
Figure 2D:
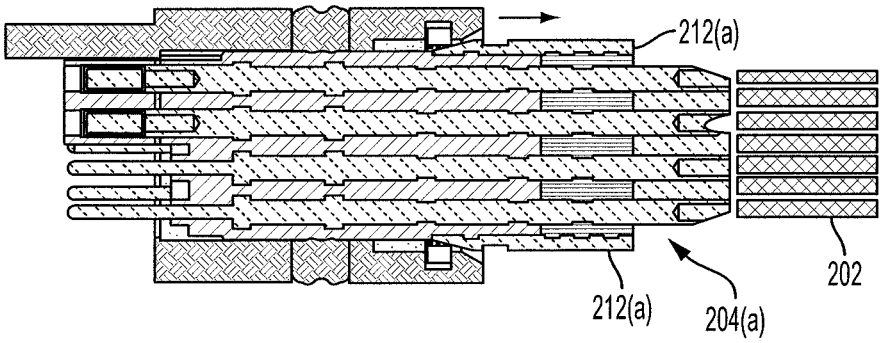
Figure 2E:
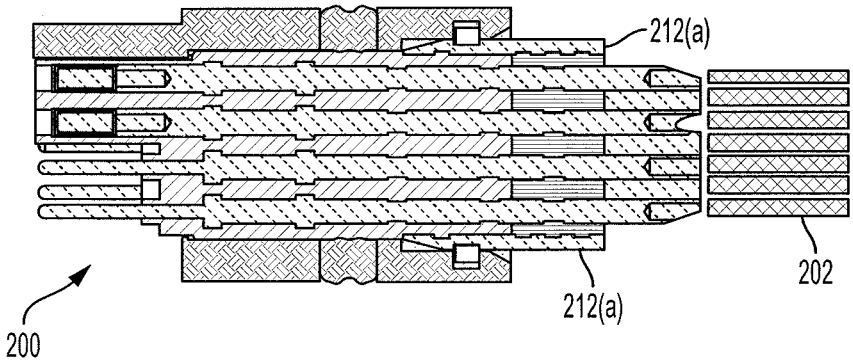

Referring to FIGS. 2C-2E, the connector 202 may have a first terminated end portion 204(*a*) and a second terminated end portion 204(*b*). The first terminated end portion 204(*a*) may be configured to connect to another connector or device via a first end connecting part 210(*a*), and the second terminated end portion 204(*b*) may be configured to connect to another connector or device via a second end connecting part 210(*b*). A first insert-assembly sleeve portion 212(*a*) (or sleeve portion 212(*a*)) may have an outer surface and an inner surface defining a hollow portion, the inner surface surrounding (or sandwiching) at least a portion of the first terminated end portion 204(*a*), and the outer surface having at least one radially inward groove 228(*a*). The first sleeve portion 212(*a*) may be made of a metal and/or plastic. The first sleeve portion 212(*a*) may be either plated or non-plated, either fiber reinforced, mineral reinforced, or non-reinforced (where mechanical wear is relatively trivial). The first sleeve portion 212(*a*) may be attached to the insert assembly 216(*a*). For example, the first sleeve portion 212(*a*) may be insert molded with the insert assembly 216(*a*).

As shown in FIGS. 2C and 2D, a first outer body 220(*a*) may slide over an insert assembly 216(*a*) in direction 224. The first outer body 220(*a*) may be, for example, a sealing housing for insertion into a fixture, housing, or tool 206.

At least one first-end retaining portion 214(*a*) may extend radially inward from the first outer body 220(*a*). As shown in the sequence of assembly of FIGS. 2C-2E, the first outer body 220(*a*) slides over the plastic insert assembly 216(*a*) and further slides over a tapered portion of the first sleeve portion 212(*a*), the first-end retaining portion 234(*a*) is positioned (for example, snapped) into the at least one radially inward groove 228(*a*). When the first-end retaining portion 234(*a*) is positioned into the at least one radially inward groove 228(*a*), the first terminated end portion 204(*a*) is secured into the first outer body 220(*a*). This ensures that the first terminated end portion 204(*a*) and/or the connector 202 are not displaced in presence of pressure, shock, vibration, and other environmental conditions in which mechanical robustness is needed.

The first-end retaining portion 234(*a*) may be, for example, a first-end retaining clip or a first-end retaining ring extending from an inner portion 233(*a*) of the first outer body 220(*a*). The first-end retaining portion 234(*a*) may be configured to slide over the insert assembly 216(*a*), and then over a tapered portion of the first sleeve portion 212(*a*). Alternatively, the tapered portion may have a curved or straight slope such that the first sleeve portion 212(*a*) has a narrower width along a radial axis 265 (substantially perpendicular to a longitudinal axis 266) for allowing the first-end retaining portion 234(*a*) to slide smoothly over the first sleeve portion 212(*a*) before the first-end retaining portion 234(*a*) snaps in place into the at least one radially inward groove 228(*a*).

Figure 1A:
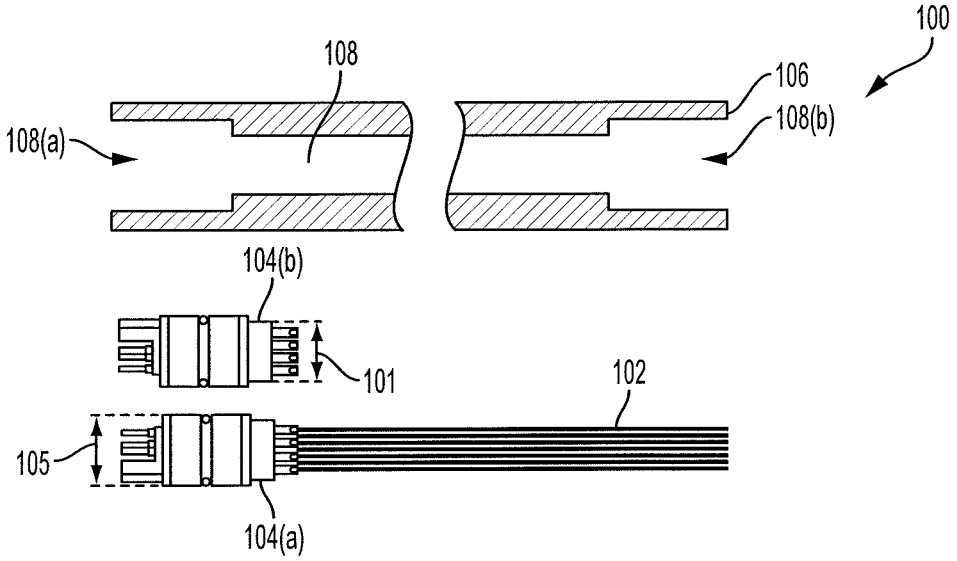
FIG. 1A PRIOR ART
FIGS. 1A and 1B each illustrate a connector that requires termination after insertion into a tool, according to certain embodiments known in the art.
Figure 1B:
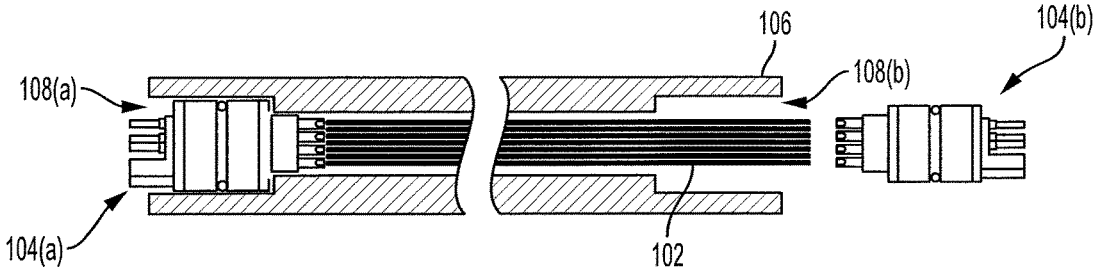
FIG. 1B PRIOR ART
Figure 2F:
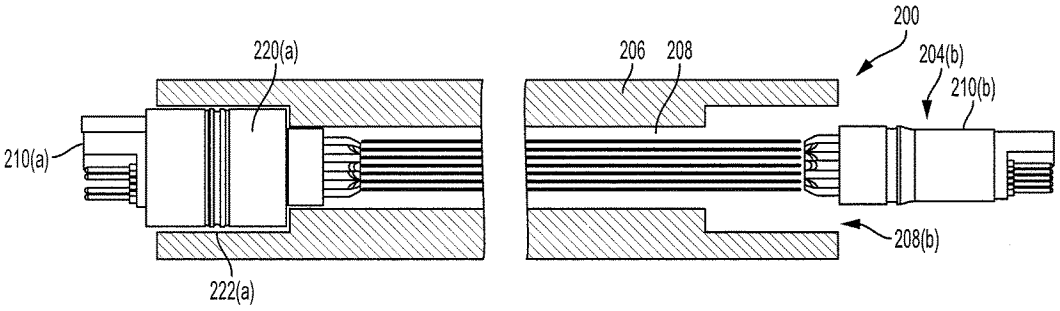
Figure 2G:
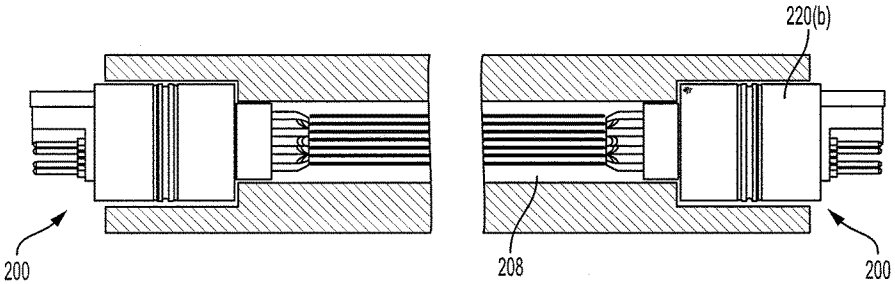

Referring to FIG. 2F, after the first terminated end portion 204(*a*) is fitted into the first outer body 220(*a*), the connector assembly 200 may be assembled into the hollow portion 208 of the fixture, housing, or tool 206. Then, in a similar manner as described above with respect to FIGS. 2A-2E, the second terminated end portion 204(*b*) may be assembled in a second outer body 220(*b*), as shown in the sequence of assembly of FIGS. 2F and 2G. Securing the second terminated end portion 204(*b*) in the second outer body 220(*b*) further ensures that the first terminated end portion 204(*a*), the second terminated end portion 204(*a*), and/or the connector 202 are not displaced in presence of pressure, shock, vibration, and other environmental conditions in which mechanical robustness is needed. The entire connector assembly 200 may then be installed into the hollow portion 208. The entire installation of the connector assembly 200 may take seconds as opposed to several minutes for embodiments known in the art (for example, as discussed above with respect to FIGS. 1A and 1B).

The first terminated end portion 204(*a*) may include at least one of a pin 203(*a*) and/or a socket 218(*a*) (for accepting a pin insertion). The pin 203(*a*) and/or the socket 218(*a*) connected to the connector 202 for establishing a connection between the connector 202 and another connector or device. For example, the pin 203(*a*) and/or the socket 218(*a*) may be connected to a hyperboloid contact of the connector 202. The pin 203(*a*) and/or the socket 218(*a*) can be insulated from one another and/or can be insulated from other pins/sockets using intermittently positioned insulating members 207(*a*) and 209(*a*).

A sealing portion 222(*a*) may be made of an elastomer molded in an opening of the first outer body 220(*a*), and the elastomer may be made of rubber such as a Fluoroelastomer (e.g., Viton®) or High Performance Perfluoroelastomer (such as Kelraz®).

The sealing portion 222(*a*) may be, for example, an O-ring radially surrounding at least a portion of the first terminated end portion 204(*a*), thereby sealing the first terminated end portion 204(*a*) into the first outer body 220(*a*). Inclusion of the O-ring is optional depending on the sealing protection required, for example, based on environments in which the connector assembly 200 will be applied. For example, in oil field applications with stringent sealing requirements, the sealing portion 222(*a*) such as the O-ring may be provided. The sealing portion 222(*a*) may be connected to a connector core of the first terminated end portion 204(*a*).

Figure 2H:
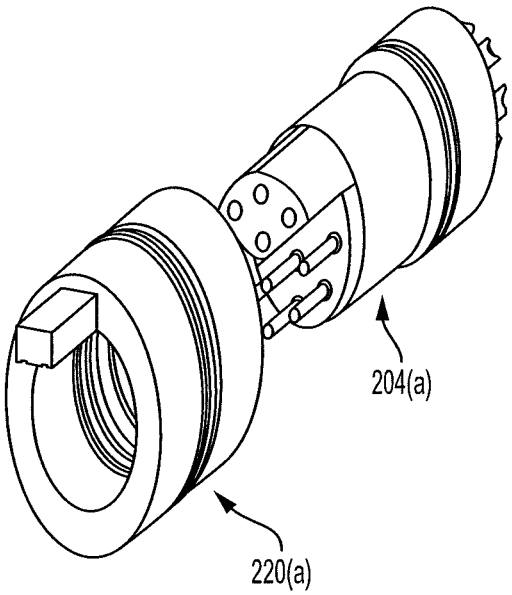
Figure 2I:
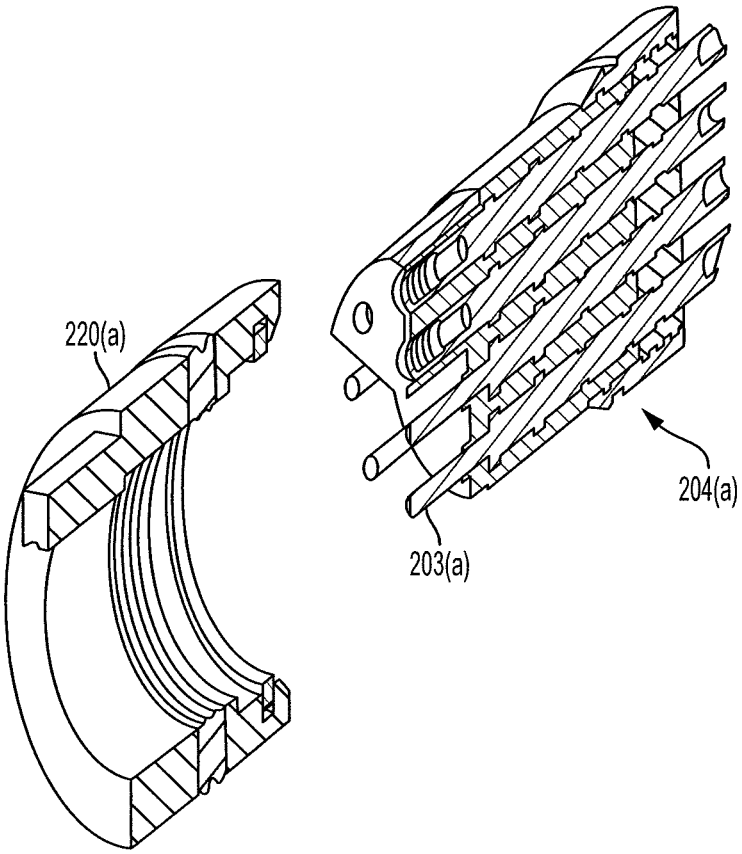

FIGS. 2H and 2I show isometric views of the first terminated end portion 204(*a*) and the first outer body 220(*a*) before the first outer body 220(*a*) is assembled over the first terminated end portion 204(*a*).

Figure 2J:
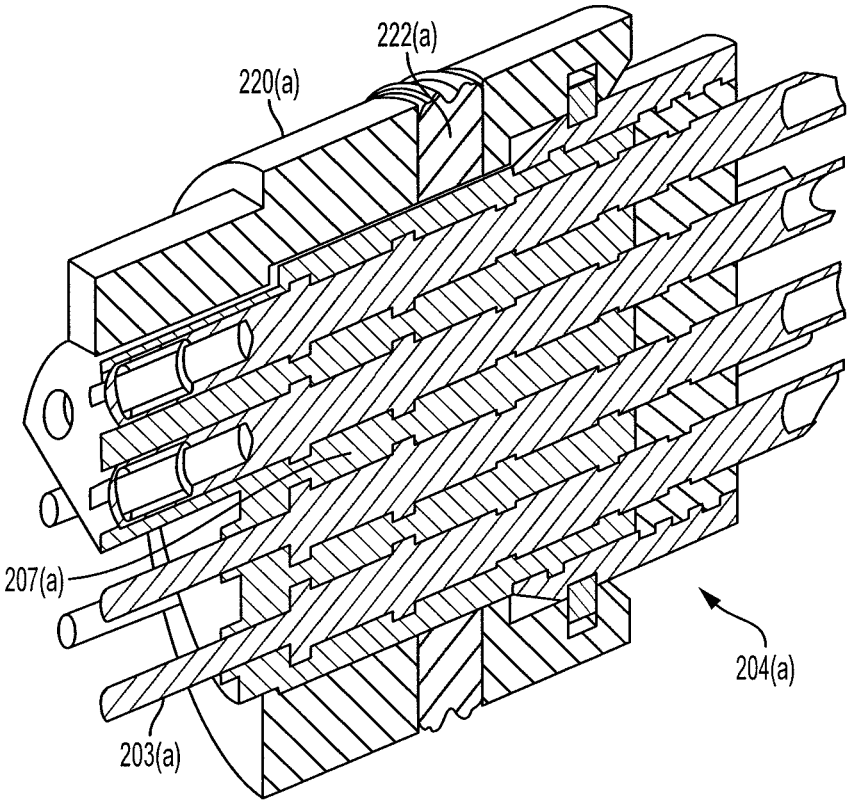

FIG. 2J shows an isometric section view of the first terminated end portion 204(*a*) and the first outer body 220(*a*) after the first outer body 220(*a*) is assembled over the first terminated end portion 204(*a*) according to an embodiment of the present invention.

Figure 2K:
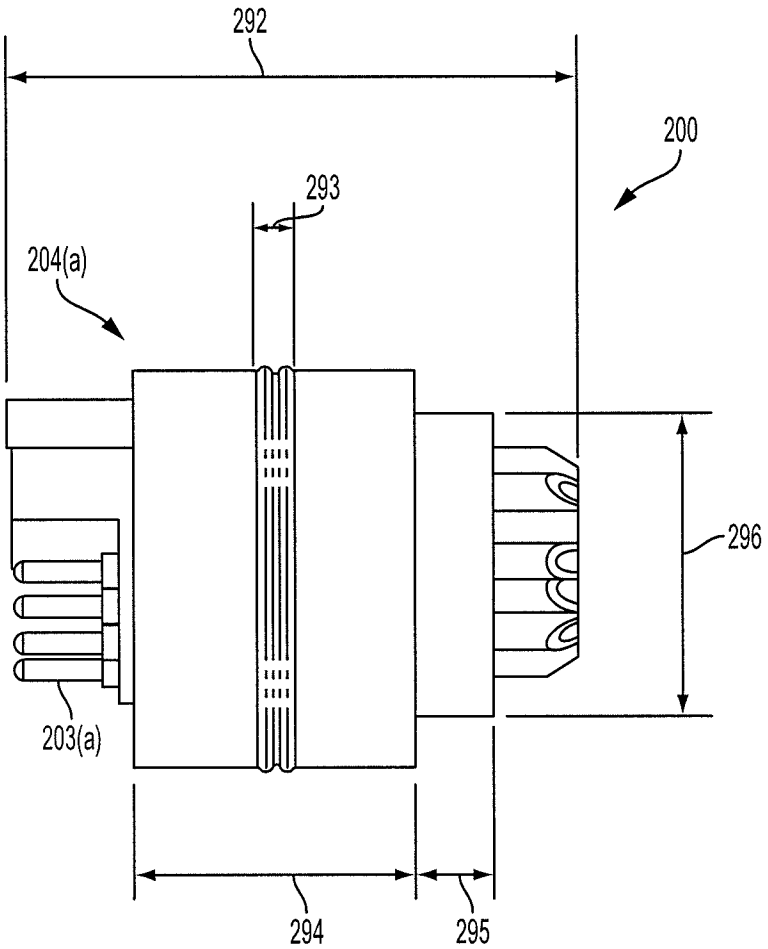
Figure 2L:
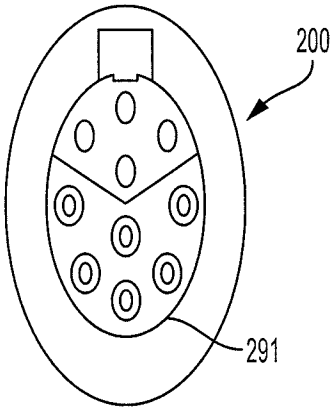

FIG. 2K shows a side view of the connector assembly 200 and corresponding dimensions, according to an embodiment of the present invention. FIG. 2L shows a view of the connector assembly 200 looking into the connector assembly 200 along the longitudinal axis of the first terminated end portion 204(*a*). In an embodiment, dimensions 291, 292, 293, 294, 295, and 296 may be, for example, 12.62 millimeters (mm) (0.497 inches (in)), 46.15 mm (1.817 in), 3.81 mm (0.150 in), 22.61 mm (0.890 in), 6.58 mm (0.259 in), and 14.58 mm (0.574 in), respectively. In other embodiment, dimensions 291, 292, 293, 294, 295, and 296 may be, for example, in the ranges of 11-13 mm (0.433-0.511 in), 42-48 mm (1.653-1.818 in), 4-5 mm (0.157-0.196 in), 20-24 mm (0.787-0.944 in), 5-8 mm (0.196-0.314 in), 13-16 mm (0.511-0.630 in), and 14-16 mm (0.551-0.630 in), respectively.

FIGS. 3A-3F illustrate a pre-terminated connector fitted into a first outer body 320(*a*) using a plurality of first-end retaining portions 334(*a*), 336(*a*), and 338(*a*) positioned in a plurality of grooves 328(*a*), 330(*a*), and 332(*a*), respectively, to form a connector assembly 300 that is capable of being fitted into a hollow portion (e.g., the hollow portion 208 discussed above) of a tool, fixture, housing, or the like (e.g., the tool, fixture, housing, or the like 208 discussed above), according to certain embodiments of the present invention. The three first-end retaining portions 334(*a*), 336(*a*), and 338(*a*) may be a plurality of retaining clips or rings, respectively. The three first-end retaining portions 334(*a*), 336(*a*), and 338(*a*) may radially surround (or sandwich) the first terminated end portion 304(*a*). A different number of retaining portions or rings may be utilized based on various design concerns, for example, the degree of robustness needed. Using multiple retention portions over the longitudinal length of the first insert-assembly sleeve portion 312(*a*) (first sleeve portion 312(*a*)) would further ensure that the first terminated end portion 304(*a*), and/or the connector 302 are not displaced in presence of pressure, shock, vibration, and other environmental conditions in which a high degree of mechanical robustness is needed.

In one embodiment, after assembly, a first groove 328(*a*) may have a shorter longitudinal distance to the tapered portion of the first sleeve portion 312(*a*) than the longitudinal distance of the second groove 330(*a*) to the tapered portion of the first sleeve portion 312(*a*). The first groove 328(*a*) may have a longitudinal length that is smaller than a longitudinal length of a second groove 330(*a*). Similarly, the longitudinal length of the second groove 330(*a*) may be smaller than the longitudinal length of the third groove 332(*a*). The order of progression of longitudinal lengths advantageously ensures that the larger retaining portions (e.g., retaining clips) do not get positioned in the smaller grooves as the first outer body 320(*a*) slides over the first sleeve portion 312(*a*).

The second terminated end portion 304(*b*) of the connector 302 may be assembled in a second outer body 320(*b*) similar to the process described above with respect to the first terminated end portion 304(*a*) and the first outer body 320(*a*).

Figures 3A, 3B:
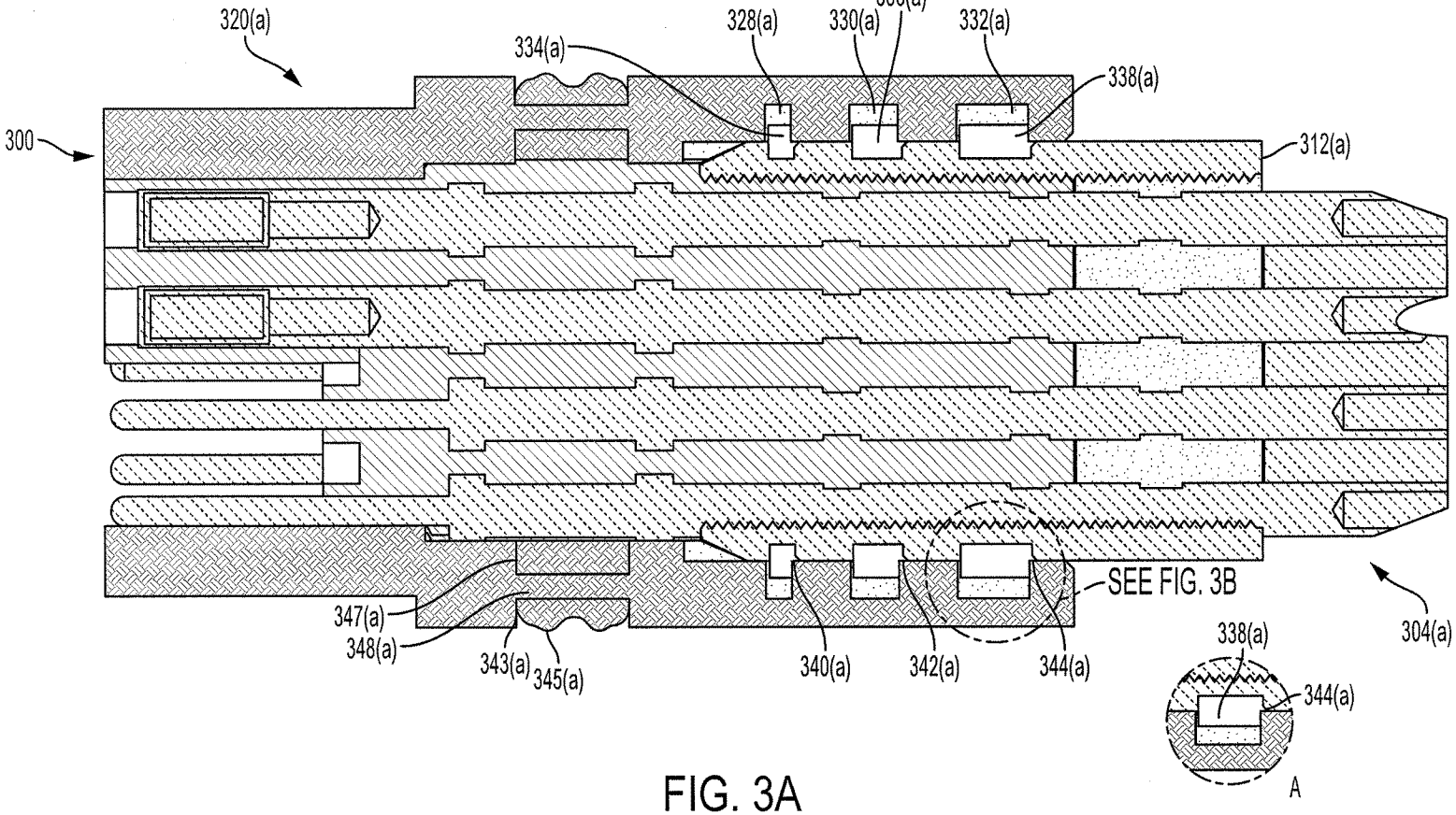
FIGS. 3A-3F each illustrate a pre-terminated connector fitted into an outer body using a plurality of retaining portions positioned in a plurality of grooves to form a connector assembly that is capable of being fitted into a hollow portion of a tool, fixture, housing, or the like, according to certain embodiments of the present invention.

In certain embodiments, the first sleeve portion 312(*a*) ("first sleeve portion" 312(*a*)) may include one or more chamfered portions 340(*a*), 342(*a*), and 344(*b*) for assisting guiding of the first outer body 320(*a*) over the first sleeve portion 312(*a*) and for preventing stubbing of the first-end retaining portions 334(*a*), 336(*a*), and/or 338(*a*). For example, FIG. 3B is a detail view of the "A" circle portion, showing the chamfered portion 344(*a*).

Figure 3C:
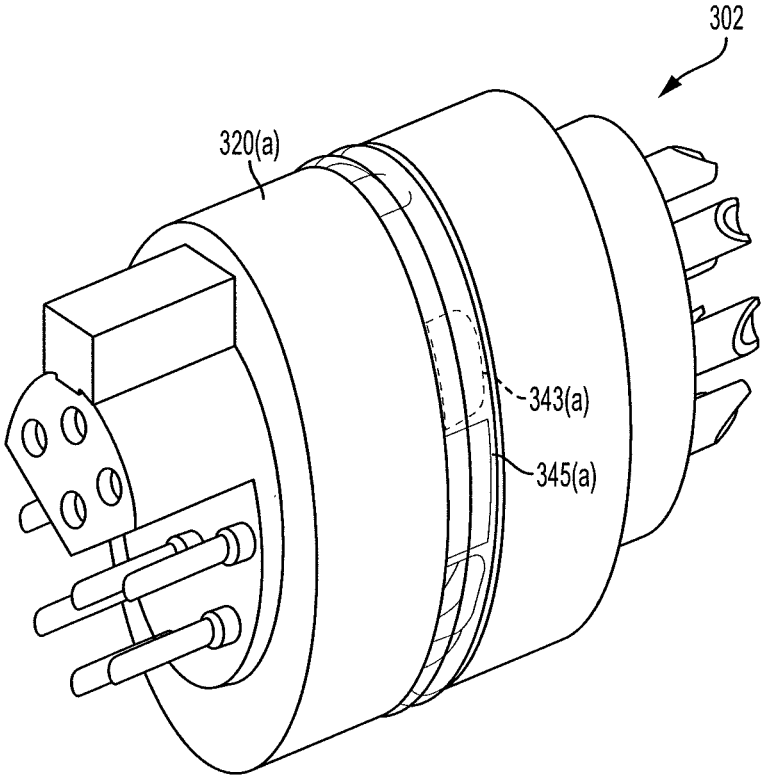

As shown in FIGS. 3A, 3C, 3D, 3E, and 3F, the first outer body 320(*a*) may include an inner surface radially proximal to the connector 302 and an outer surface radially distal to the connector 302. FIG. 3C shows an isometric view of the first outer body 320(*a*) after assembly over the first terminated end portion 304(*a*). As shown in FIGS. 3A and 3C-3F, the outer surface of the first outer body 320(*a*) may have a radially inward groove 343(*a*), and a first sealing portion 345(*a*) positioned into the radially inward groove 343(*a*) for providing a seal between first outer body 320(*a*) and the inner surface of the fixture, housing, or tool 306. The first sealing portion 345(*a*) may be an elastomer molded in the radially inward groove 343(*a*) of the outer surface of the first outer body 320(*a*), and may be made of, for example, fluoroelastomer (e.g., Viton®) or a high-performance perfluoroelastomer (such as Kelraz®). Alternatively or in addition, a second sealing portion 347(*a*) may be provided similarly to the first sealing portion 345(*a*) for providing a seal between the connector 302 and the inner surface of the first outer body 320(*a*). An advantage of the molded-in rubber sealing is that it may be used to seal at least one of (I) the area between the first outer body 320(*a*) and a tool (for example, a tool similar to tool 206 as discussed above) as well as (II) the area between the first outer body 320(*a*) and the insert assembly on the exterior of the first terminated end portion 304(*a*). Similar sealing may be applied to embodiment shown in FIGS. 2C-2E discussed above in order to seal the area between the first outer body 220(*a*) and the tool 206 as well as the area between the first outer body 220(*a*) and the insert assembly 216(*a*).

Figure 3D:
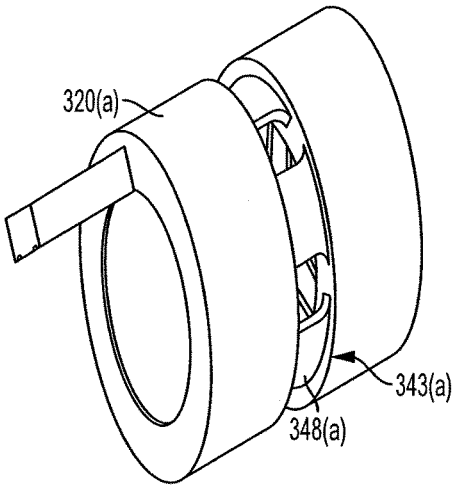
Figure 3E:
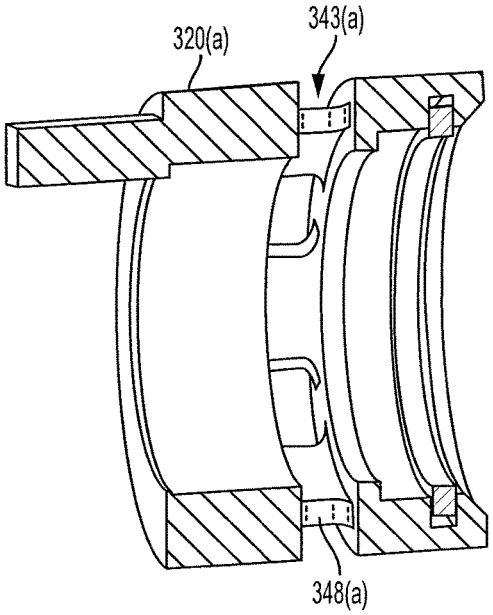
Figure 3F:
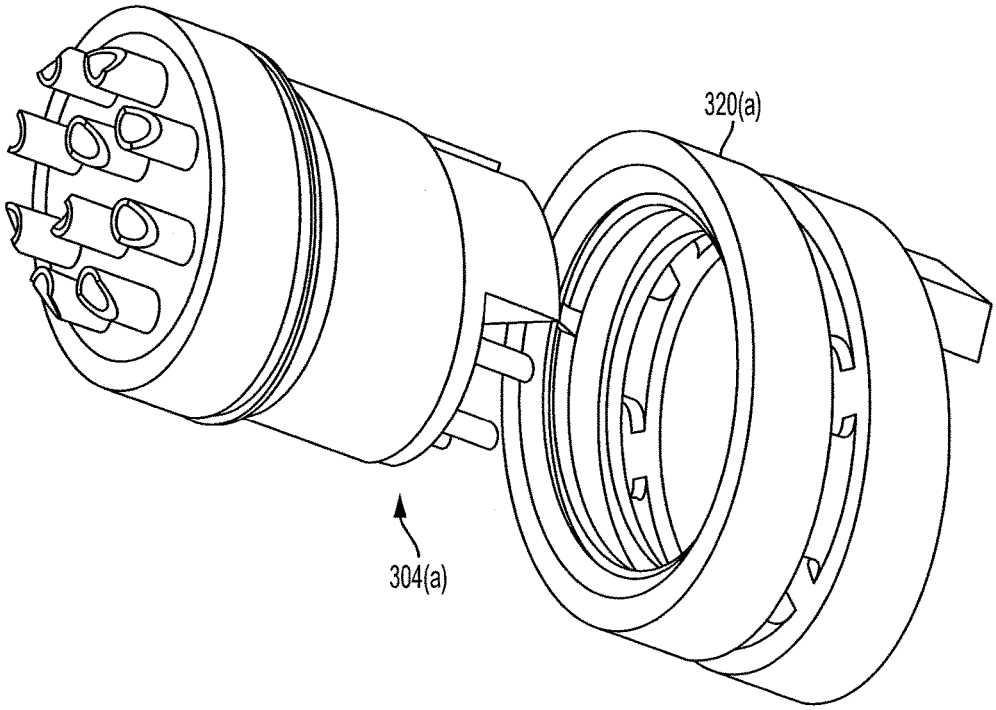

As shown in FIGS. 3C-3F, sealing portions may be filled into openings around a metal shell having a plurality of bridges 348(*a*) connecting two parts of the first outer body 220(*a*). FIGS. 3D, 3E and 3F illustrate an isometric view, an isometric section view, and a backside perspective view of openings of the first outer body 320(*a*) before addition of the sealing portions. The first outer body 320(*a*) may include a metal housing which includes a plurality of bridges 348(*a*) that are positioned radially inward of the outer surfaces of the first part and the second part of the first outer body 320(*a*) that are joined by the plurality of bridges 348(*a*), thereby defining a radially inward grooves 343(*a*) for insertion of the sealing portions. In certain embodiments, sealing portions may be over-molded in the openings shown around the plurality of bridges 348(*a*). A unique advantage of utilizing the metal housing with the plurality of bridges is to mechanically retain the molded sealing portions. The metal housing may be made of, for example, stainless steel or a high-nickel alloy such as Inconel, Hastolloy, or Monel.

FIGS. 4A-4L illustrate a pre-terminated connector 402 fitted into a first outer body 420(*a*) having at least two removable parts 452(*a*) and 453(*a*) (e.g., clamshell parts) surrounding (or sandwiching) the pre-terminated connector 402 from opposite sides to form a connector assembly 400 capable of being fitted into a hollow portion 408 of a tool, fixture, housing, or the like 406, according to certain embodiments of the present invention. 100401 A connector 402 may be provided having a first terminated end portion 404(*a*) and a second terminated end portion 404(*b*). The connector 402 may first be inserted through the hollow portion 408 of the fixture, housing, or tool 406. A first outer body 420(*a*) may include a first removable part 452(*a*) and a second removable part 453(*a*) configured to be positioned opposite of the first removable part 452(*a*). The first removable part 452(*a*) and the second removable part 453(*a*) may be connected together in the direction 456 similar to a joining clamshell around the backside of the connector 402. The first removable part 452(*a*) and the second removable part 453(*a*) of the first outer body 420(*a*) may have an outer surface and an inner surface, the inner surfaces together forming a hollow portion configured to accept at least a portion of the first terminated end portion 404(*a*). A first outer-body sleeve portion 454(*a*) may also be provided having an inner surface defining a hollow portion configured to accept at least a portion of the first terminated end portion 404(*a*). The first outer-body sleeve portion 454(*a*) may also be configured to connect with the first removable part 452(*a*) and the second removable part 453(*a*) of the first outer body 420(*a*), and the first outer-body sleeve portion 454(*a*) may be configured to be inserted into the hollow portion 408 of the fixture, housing, or tool 406.

Figure 4A:
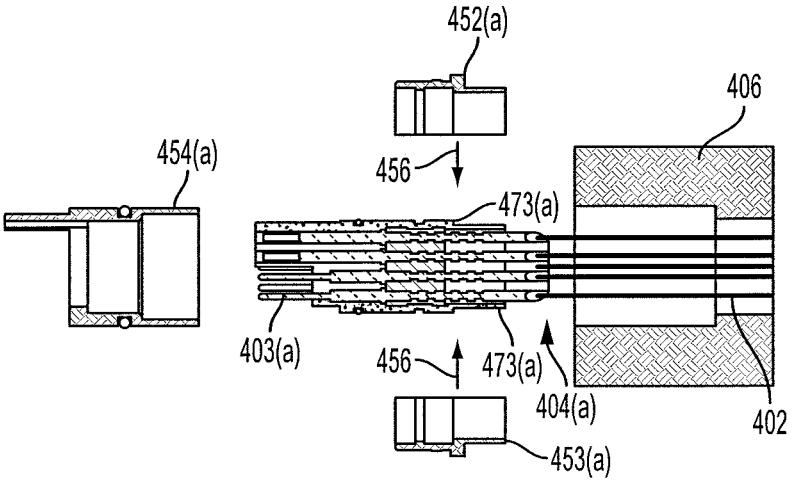
FIGS. 4A-4L each illustrate a pre-terminated connector fitted into a first outer body having at least two removable parts surrounding (or sandwiching) the pre-terminated connector from opposite sides to form a connector assembly capable of being fitted into a hollow portion of a tool, fixture, housing, or the like, according to certain embodiments of the present invention.
Figure 4B:
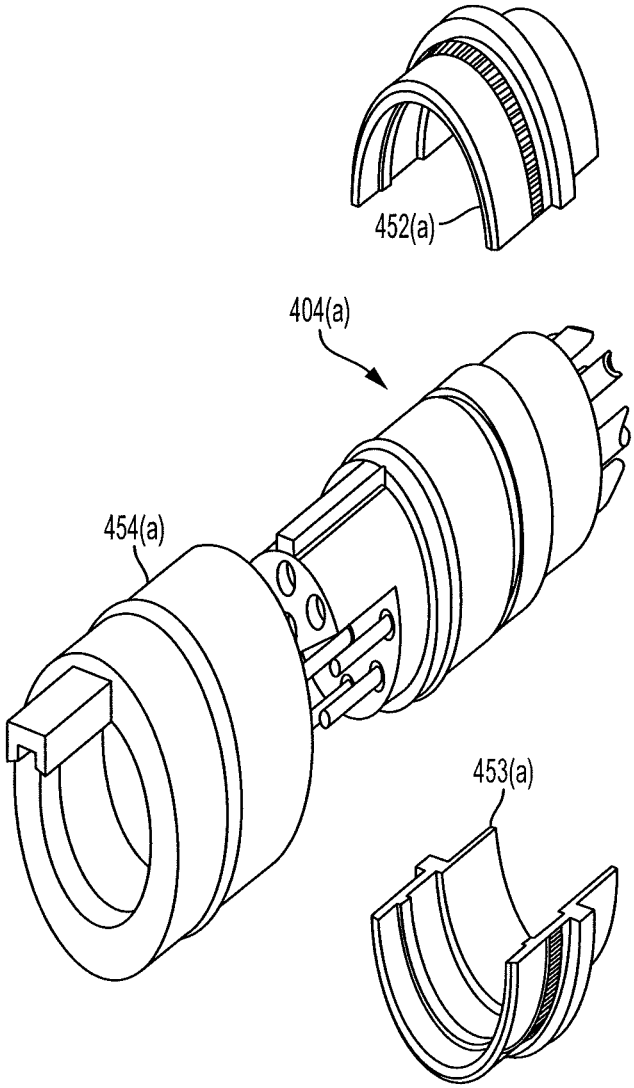
Figure 4C:
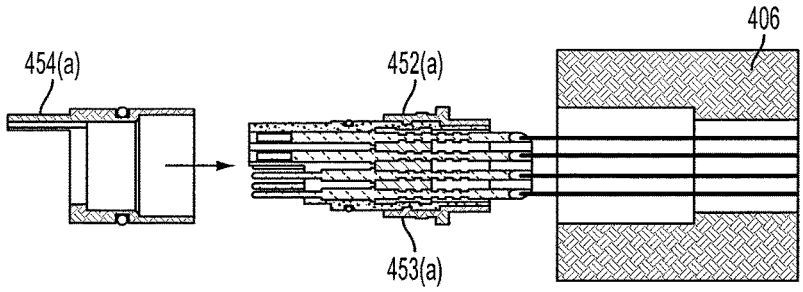
Figure 4D:
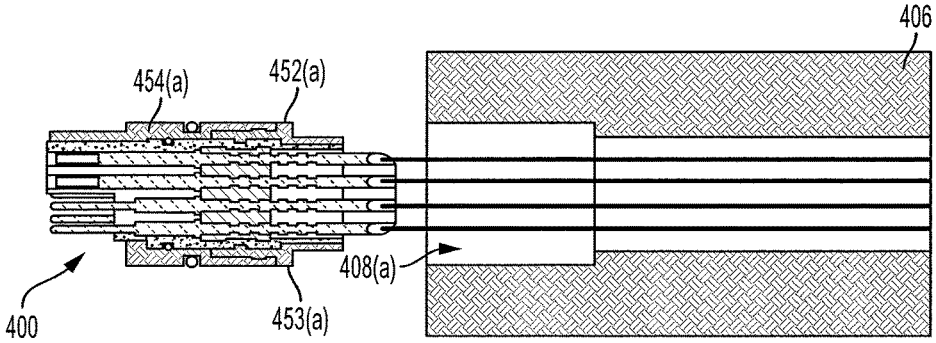
Figure 4E:
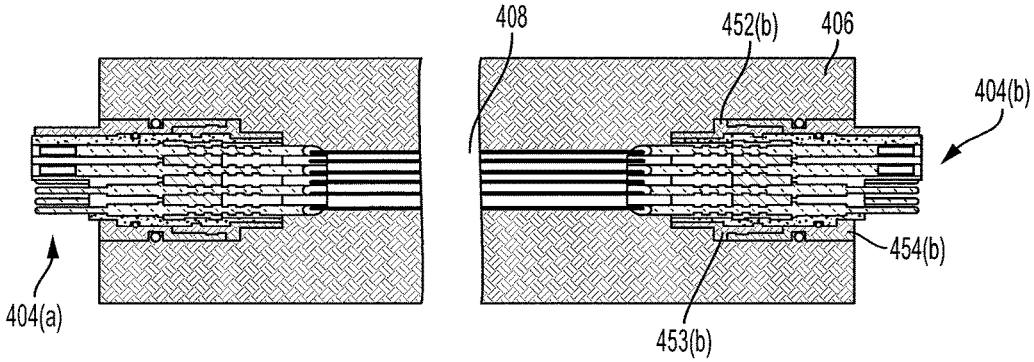
Figure 4F:
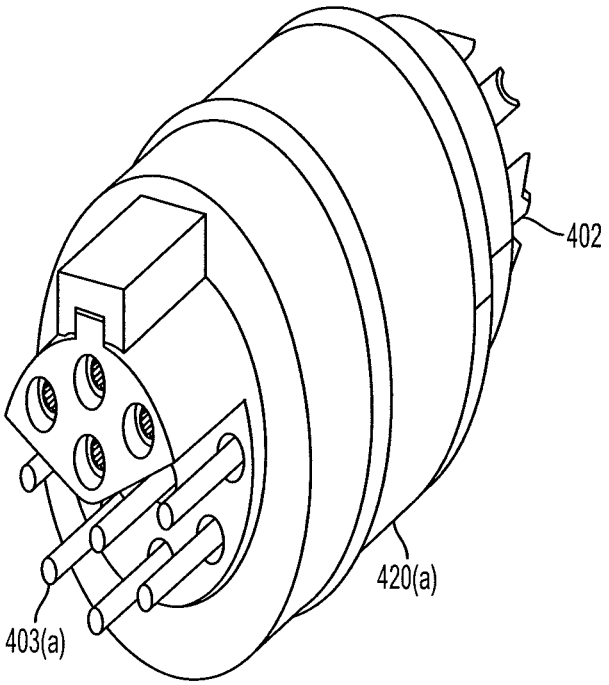
Figure 4G:
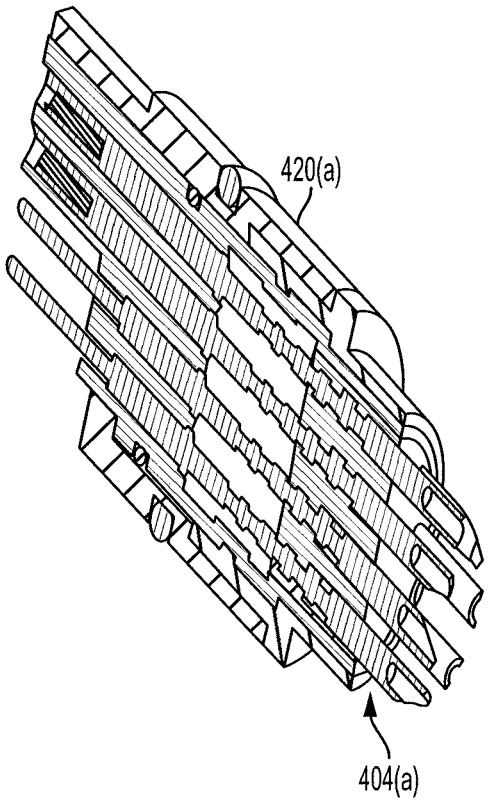

FIGS. 4A and 4B illustrate the first removable part 452(*a*), the second removable part 453(*a*), the connector 402, and the first outer-body sleeve portion 454(*a*) prior to assembly. FIG. 4C shows the first removable part 452(*a*) and the second removable part 453(*a*) positioned on radially opposite sides of the connector 402. As shown by the arrow in FIG. 4C, the first outer-body sleeve portion 454(*a*) may slide over the connector 402. As shown in FIG. 4D, the first outer-body sleeve portion 454(*a*) may connect to the first removable part 452(*a*) and the second removable part 453(*a*) using interconnecting members (for example, a latch). An isometric view and an isometric section view of the resulting connector assembly 400 are shown in FIGS. 4F and 4G, respectively. The resulting connector assembly 400 may be inserted into the first hollow end 408(*a*) of the hollow portion 408 of the fixture, housing, or tool 406, as shown in FIG. 4D.

The second terminated end portion 404(*b*) may be assembled with the second outer-body sleeve portion 454(*b*), the first removable part 452(*b*) of the second outer body 420(*b*), the second removable part 453(*b*) of the second outer body 420(*b*), and the second outer-body sleeve portion 454(*b*) similar to the process described above with respect to FIGS. 4A-4D. As shown in FIG. 4E, the second terminated end portion 404(*b*) may be assembled and inserted into the second hollow end 408(*b*) of the hollow portion 408 before or after the first terminated end portion 404(*a*) is inserted into the first hollow end 408(*a*) of the hollow portion 408.

Figure 4H:
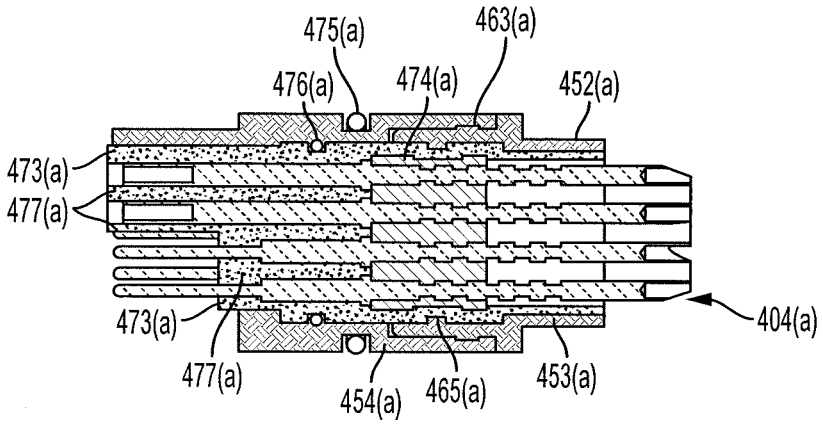

FIG. 4H shows various optional features that may be included in the connector assembly 400 based on design needs. For example, a first plurality of interconnecting parts 463(*a*) may be provided to secure the connection between the first outer-body sleeve portion 454(*a*) and the first removable part 452(*a*). As can be seen in FIG. 4H, the first outer-body sleeve portion 454(*a*) and the second removable part 453(*a*) are similarly connected. In addition or alternatively, a second plurality of interconnecting parts 465(*a*) may be provided on the first removable part 452(*a*) and the second removable part 453(*a*) for securing the first removable part 452(*a*) and the second removable part 453(*a*) with the connector 402, thereby preventing the first removable part 452(*a*) and the second removable part 453(*a*) from sliding to the right. The first plurality of interconnecting parts 463(*a*) and/or the second plurality of interconnecting parts 465(*a*) may include latches, knurling, interference fit, threading, various other securing mechanisms, and/or combinations thereof to secure the first outer-body sleeve portion 454(*a*), the first removable part 452(*a*), and the second removable part 453(*a*) in presence of pressure, shock, vibration, and other environmental conditions in which mechanical robustness is needed.

Referring to FIG. 4H, an outer sealing portion 475(*a*) (e.g., an elastomer O-ring) may be provided for sealing the connection between the inner surface of the fixture, housing, or tool 406 and the first outer-body sleeve portion 454(*a*), the first removable part 452(*a*), and the second removable part 453(*a*). In addition or alternatively, an inner sealing portion 476(*a*) (e.g., an elastomer O-ring) may be provided for sealing the connection between the connector 402(*a*) and the inner surfaces of the first outer-body sleeve portion 454(*a*), the first removable part 452(*a*), and the second removable part 453(*a*). The connector assembly 400 may further include an outer insulating portion 473(*a*) positioned between the first removable part 452(*a*) and the pins of the first terminated end portion 404(*a*).

The outer insulating portion 473(*a*) may be made of a high temperature polymer, either reinforced or non-reinforced for example, PEEK (polyether ether ketone), PEKK (polyether ketone ketone), or 0-45% fiber filled. Inner insulating portions 477(*a*) may be provided between electronic contacts, pins, and/or sockets of the connector 402 and may be made of similar material to the outer insulating portion 473(*a*). Epoxy portions 474(*a*) may be positioned around electronic contacts which may be made of metal, for example, a copper alloy. In other embodiments, the epoxy portions 474(*a*) may be made of various insulating and/or elastic materials without limiting the scope of the present invention.

In other embodiments, in addition or alternatively, the molded sealing portion discussed above with respect to 2A-2G may be implemented on the embodiments discussed herein with respect to FIGS. 4A-4H. For example, the first outer-body sleeve portion 454(*a*) may include a metal housing with molded sealing portions to seal any space between the outer insulating portion 473(*a*) and the first outer-body sleeve portion 454(*a*) as well as any space between the first outer-body sleeve portion 454(*a*) and an inner surface of the fixture, housing, or tool 406 in the hollow portion 408, as discussed above with respect to FIGS. 3A-3F. The inner elastomer rings, the outer elastomer rings, the inner molded sealing portions, and/or the outer molded sealing portions may be implemented in any of the embodiments described herein. These features are important when the connection assemblies are used in environments with stringent sealing requirements such as in oil applications.

Figure 4J:
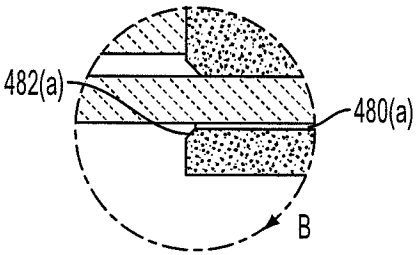
Figure 4I:
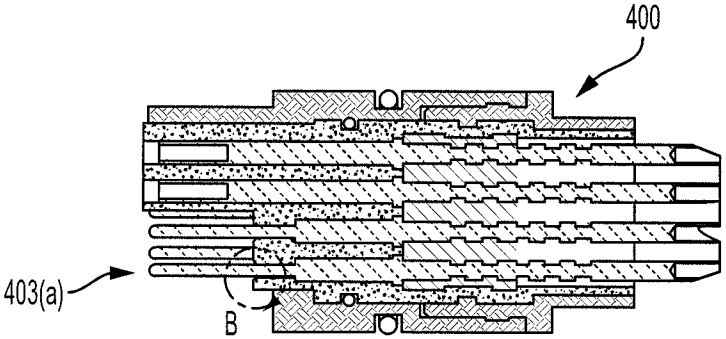

As shown in the side cross section view of the connection assembly 400 in FIG. 4I, and as shown in the detail view of portion marked by "B" and shown in FIG. 4J, an open space 480(*a*) may be provided around the pin 403(*a*). An insulating portion around the pin 403(*a*) may also have a chamfered portion 482(*a*). The open space 480(*a*) and the chamfered portion 482(*a*) provide relief for the pin 403(*a*) in presence of sheer stress, thereby reducing likelihood of damage to the pin 403(*a*).

Figure 4K:
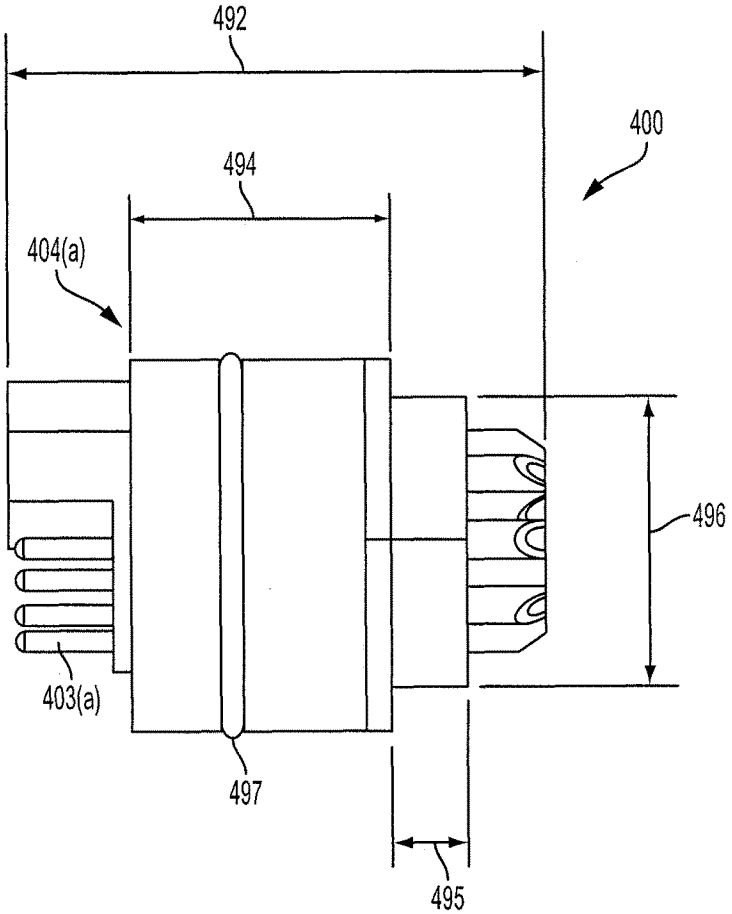
Figure 4L:
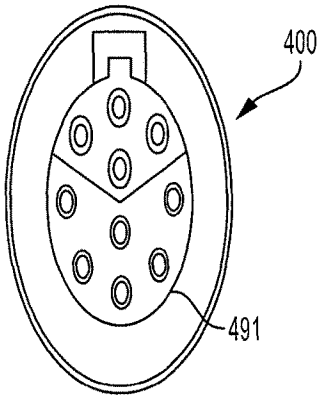

FIGS. 4K shows a side view of the connector assembly 400 and corresponding dimensions, according to an embodiment of the present invention. FIG. 4L shows a view of the connector assembly 400 looking into the connector assembly 400 along the longitudinal axis of the first terminated end portion 404(*a*). In an embodiment, dimensions 491, 492, 494, 495, 496, and 497 may be, for example, 12.57 millimeters (mm) (0.495 inches (in)), 46.18 mm (1.818 in), 22.48 mm (0.885 in), 6.45 mm (0.254 in), 14.63 mm (0.576 in), and 1.79 mm (0.070 in), respectively. In other embodiment, dimensions 491, 492, 494, 495, 496, and 497 may be, for example, in the ranges of 11-13 mm (0.433-0.511 in), 42-48 mm (1.818 in), 20-24 mm (0.787-0.944 in), 5-8 mm (0.196-0.314 in), 13-16 mm (0.511-0.630 in), and 1-3 mm (0.039-0.118 in).

Figure 5:
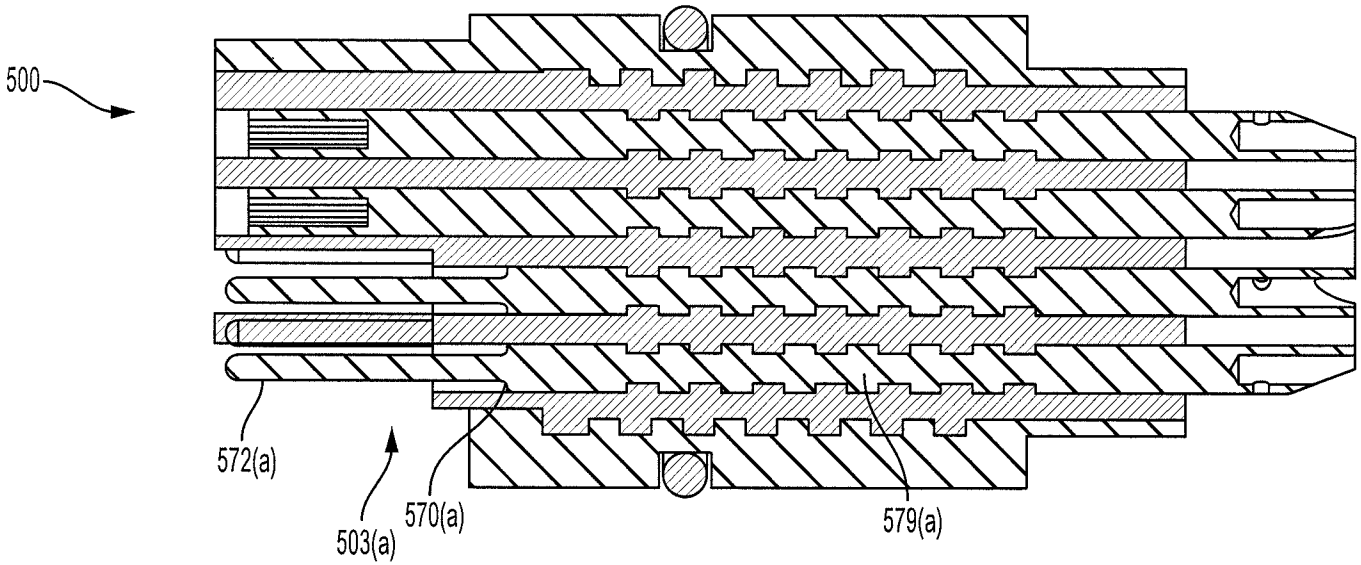
FIG. 5 illustrates pins used in a connector assembly, the pin being configured to withstand pressure, shock, vibration, and other environmental conditions in which mechanical robustness is needed, according to certain embodiments of the present invention.

FIG. 5 illustrates a pin 503(*a*) in a connector assembly 500, the pin 503(*a*) being configured to withstand pressure, shock, vibration, and other environmental conditions in which mechanical robustness is needed, according to certain embodiments of the present invention. A radius 570(*a*) may be applied to the transition between the mating portion 572(*a*) of the pin 503(*a*) and the main body 579(*a*) of the pin 503(*a*). The applied radius 570(*a*) may eliminate or reduce stress concentration under applied pressure, shock, vibration, or other environmental conditions in which mechanical robustness is needed.

Various embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed into the scope of the patent warranted hereon are all such embodiments that reasonably fall into the scope of the advancement to the art hereby contributed, and that that scope shall not be restricted, except in light of the appended claims and their equivalents.

The invention claimed is:

1. A connector assembly for insertion into a hollow portion of a tool, a fixture, or a housing, the connector assembly comprising:

a connector having a first terminated end portion and a second terminated end portion;

a first sleeve portion having an outer surface and an inner surface defining a hollow portion for insertion of least a portion of the first terminated end portion, and the outer surface having at least one radially inward groove;

a first outer body having a hollow portion for insertion of at least a portion of the first sleeve portion; and at least one first-end retaining portion extruding radially inward and configured to be positioned into the at least one radially inward groove for securing at least a portion of the first terminated end portion in the first outer body.

2. The connector assembly of claim 1, further comprising:

a second outer body having a hollow portion for insertion of at least a portion of the first sleeve portion; and at least one second-end retaining portion extending radially inward from the second outer body and positioned into the at least one radially inward groove for securing at least a portion of the second terminated end portion in the second outer body.

3. The connector assembly of claim 1, wherein at least one of the first terminated end portion or the second terminated end portion includes at least one of a pin or a socket connected to the connector for establishing a connection between the connector and another connector or device.

4. The connector assembly of claim 1, wherein the connector and the first sleeve portion extend parallel to a longitudinal axis, and the first outer body includes:

a metal shell having an inner surface radially proximal to the connector and an outer surface radially distal to the connector, the metal shell including a plurality of bridges extending substantially parallel to the longitudinal axis and further including a plurality of openings defined between the plurality of bridges, and a sealing portion positioned in the plurality of openings defined between the plurality of bridges for providing a seal between the first outer body and the inner surface of the tool, the fixture, or the housing and for providing a seal between the first outer body and an outer surface of the first terminated end portion.

5. The connector assembly of claim 1, wherein the connector and the first sleeve portion extend parallel to a longitudinal axis, the first sleeve portion includes a first end positioned into the hollow portion of the first outer body, a second end, a body portion between the first end and the second end, and a first end portion including the first end and connected to the body portion, and the first end portion is tapered such that a radial width of the first end portion is smaller than a radial width of the body portion for allowing the first outer body to slide in a direction parallel to the longitudinal axis over the first sleeve portion.

6. The connector assembly of claim 5, wherein the at least one radially inward groove includes a first radially inward groove and a second radially inward groove, the first radially inward groove being positioned between the second radially inward groove and the first end of the first sleeve portion, and a length of the first radially inward groove parallel to the longitudinal axis is less than a length of the first radially inward groove parallel to the longitudinal axis.

7. The connector assembly of claim 6, wherein the at least one first-end retaining portion includes a first first-end retaining portion and a second first-end retaining portion, and a length of the first first-end retaining portion parallel to the longitudinal axis is less than a length of the second first-end retaining portion parallel to the longitudinal axis for preventing the second first-end retaining portion from being positioned in the first radially inward groove or the first radially inward groove when the first outer body slides over the first sleeve portion.

8. The connector assembly of claim 1, wherein the first outer body includes an inner surface radially proximal to the connector and an outer surface radially distal to the connector, the outer surface of the first outer body has a radially inward groove, and a sealing portion positioned within the radially inward groove of the outer surface of the first outer body for providing a seal between first outer body and the inner surface of the tool, the fixture, or the housing.

9. The connector assembly of claim 8, wherein the sealing portion is an elastomer molded in the radially inward groove of the outer surface of the first outer body, and the elastomer is made of fluoroelastomer or perfluoroelastomer.

10. The connector assembly of claim 3, wherein the at least one of the pin or the socket includes a pin or a socket having a main body and a mating portion, and a radial width of the main body portion is less than a radial width of the mating portion for providing relief for the pin or the socket when subject to stress, vibration, or a mechanical force.

11. The connector assembly of claim 1, wherein the first terminated end portion includes a connector core having a plurality of pins positioned therein, and a first sealing portion connected to the connector core for providing a seal between the first terminated end portion and the inner surface of the tool, the fixture, or the housing.

12. The connector assembly of claim 1, wherein the connector is configured to establish at least one of an electrical connection, an optical connection, a hydraulic connection, or a pneumatic connection with at least another connector or device.

13. A connector assembly for insertion into a hollow portion of a tool, a fixture, or a housing, the connector assembly comprising:

a connector having a first terminated end portion and a second terminated end portion;

a first outer body having a first removable part and a second removable part configured to be positioned opposite of the first removable part and to be connected with the first removable part using a first plurality of interconnecting members, each of the first removable part and the second removable part having an outer surface and an inner surface, the inner surface of first removable part connected with the inner surface of the second removable part forming a hollow portion for insertion of at least a portion of the first terminated end portion; and a first outer-body sleeve portion having an inner surface defining a hollow portion for insertion of at least a portion of the first terminated end portion, the first outer-body sleeve portion being configured to connect with the first removable part of the first outer body and the second removable part of the first outer body using a second plurality of interconnecting members, wherein the first outer-body sleeve portion, the first removable part and the second removable part are configured to be inserted into the hollow portion of the tool, the fixture, or the housing.

14. The connector assembly of claim 13, further comprising:

a second outer body having a first removable part and a second removable part configured to be positioned opposite of and connected with the first removable part of the second outer body, each of the first removable part and the second removable part of the second outer body having an outer surface and an inner surface, the inner surface of first removable part of the second outer body connected with the inner surface of the second removable part of the second outer body forming a hollow portion for insertion of at least a portion of the second terminated end portion; and a second outer-body sleeve portion having an inner surface defining a hollow portion for insertion of at least a portion of the second terminated end portion, the second outer-body sleeve portion being configured to connect with the first removable part of the second outer body and the second removable part of the second outer body, and the second outer-body sleeve portion configured to be inserted into the hollow portion of the tool, the fixture, or the housing.

15. The connector assembly of claim 13, further comprising an outer insulating portion positioned between the first removable part of the first outer body and the first terminated end portion and between the first outer-body sleeve portion and the first terminated end portion.

16. The connector assembly of claim 15, wherein the outer insulating portion includes an outer surface positioned into an inner surface of the first outer-body sleeve portion, an inner surface of the first removable part of the first outer body, and an inner surface of the second removable part of the first outer body, the outer surface of the outer insulating portion has at least one radially inward groove, and at least one elastomer ring is positioned in the at least one radially inward groove of the outer surface of the outer insulating portion for providing a seal between the outer insulating portion and at least one of the first outer-body sleeve portion, the first removable part of the first outer body, or the second removable part of the first outer body.

17. The connector assembly of claim 15, wherein the outer insulating portion is made of polyether ether ketone or polyether ether ketone ketone.

18. The connector assembly of claim 13, wherein the first plurality of interconnecting members or the second plurality of interconnecting members include a latch.

19. The connector assembly of claim 13, wherein the first outer-body sleeve portion includes an inner surface radially proximal to the connector and an outer surface radially distal to the connector, the outer surface of the first outer-body sleeve portion is configured to be inserted into the hollow portion and has at least one radially inward groove, and at least one elastomer ring positioned in the at least one radially inward groove of the outer surface of the first outer-body sleeve portion for providing a seal between the first outer-body sleeve portion and the inner surface of the tool, the fixture, or the housing.

20. The connector assembly of claim 13, wherein the first removable part of the first outer body and the second removable part of the first outer body are configured to be removable from the connector before the first outer-body sleeve portion is connected with the first removable part of the first outer body and the second removable part of the first outer body.

21. The connector assembly of claim 13, wherein at least one of the first terminated end portion or the second terminated end portion includes at least one of a pin or a socket connected to the connector for establishing a connection between the connector and another connector or device, the at least one of the pin or the socket includes a pin or a socket having a main body, a mating portion, and a transitional portion between the main body and the mating portion, and a radial width of the main body portion is greater than a radial width of the mating portion, and the transitional portion is curved for providing relief for the pin or the socket when subject to stress, vibration, or a mechanical force.

22. The connector assembly of claim 13, wherein at least one of the first terminated end portion or the second terminated end portion includes at least one of a pin or a socket connected to the connector for establishing a connection between the connector and another connector or device, the at least one of the pin or the socket includes a pin or a socket having a main body and a mating portion, and an end portion of the inner surface of the first outer-body sleeve portion proximal to the mating portion is chamfered, sloped, or curved to provide relief for the at least one of the pin or the socket.

* * * * *